US009578422B2

(12) United States Patent
Chang

(10) Patent No.: US 9,578,422 B2
(45) Date of Patent: Feb. 21, 2017

(54) MICROPHONE CAPABLE OF ACTIVELY COUNTERACTING NOISE ATTRIBUTED TO UNDESIRED VIBRATION

(71) Applicant: Taiwan Carol Electronics Co., Ltd., Taichung (TW)

(72) Inventor: Chao-Chih Chang, Taichung (TW)

(73) Assignee: Taiwan Carol Electronics Co., Ltd., Taichung (TW)

( * ) Notice: Subject to any disclaimer, the term of this patent is extended or adjusted under 35 U.S.C. 154(b) by 0 days.

(21) Appl. No.: 15/050,735

(22) Filed: Feb. 23, 2016

(65) Prior Publication Data

US 2016/0269830 A1 Sep. 15, 2016

(30) Foreign Application Priority Data

Mar. 13, 2015 (TW) ..... 104108077 A

(51) Int. Cl.
*H04R 9/08* (2006.01)
*G10K 13/00* (2006.01)

(52) U.S. Cl.
CPC ..... *H04R 9/08* (2013.01); *G10K 13/00* (2013.01); *H04R 2410/05* (2013.01); *H04R 2410/07* (2013.01)

(58) Field of Classification Search
CPC ... H04R 9/08; H04R 2410/05; H04R 2410/07; G10K 13/00; G10K 2210/3229
USPC ..... 381/355, 356, 92, 86, 163, 71.12
See application file for complete search history.

(56) References Cited

U.S. PATENT DOCUMENTS

| | | | | | |
|---|---|---|---|---|---|
| 4,504,703 | A * | 3/1985 | Schneiter | H04R 1/22 | 181/163 |
| 6,091,828 | A * | 7/2000 | Akino | H04R 9/08 | 381/170 |
| 6,614,911 | B1 * | 9/2003 | Bryson | B60R 1/12 | 381/111 |
| 2005/0063553 | A1 * | 3/2005 | Ozawa | H04R 3/005 | 381/92 |
| 2007/0253570 | A1 * | 11/2007 | Fukumoto | H04R 1/083 | 381/71.12 |
| 2011/0176698 | A1 * | 7/2011 | Tanaka | H04R 1/38 | 381/355 |
| 2012/0140972 | A1 * | 6/2012 | Akino | H04R 3/04 | 381/356 |

* cited by examiner

*Primary Examiner* — Mohammad Islam
(74) *Attorney, Agent, or Firm* — Trop Pruner & Hu, P.C.

(57) ABSTRACT

A microphone includes a capsule module including a carrier, a primary transducer unit and a secondary transducer unit. The carrier includes a hollow part mounted to a handle unit, and first and second carrier parts extending oppositely from the hollow part. The primary transducer unit is mounted to the first carrier part, and converts sound waves and vibration into a primary electrical signal a first secondary electrical signal, respectively. The secondary transducer unit is mounted to the second carrier part, and converts the vibration into a second secondary electrical signal for counteracting the first secondary electrical signal. The secondary transducer unit includes a diaphragm disposed within an airtight space.

11 Claims, 11 Drawing Sheets

MICROPHONE CAPABLE OF ACTIVELY COUNTERACTING NOISE ATTRIBUTED TO UNDESIRED VIBRATION

CROSS-REFERENCE TO RELATED APPLICATION

This application claims priority of Taiwanese Application No. 104108077, filed on Mar. 13, 2015.

FIELD

The disclosure relates to a microphone, and more particularly to a microphone capable of actively counteracting noise attributed to undesired vibration.

BACKGROUND

FIGS. 1 and 2 show a conventional microphone 9 capable of passively counteracting noise attributed to undesired vibration. The conventional microphone 9 includes a handle unit 91 defining an accommodating space 910 therein, a capsule module 92 disposed in the accommodating space 910, a windscreen 93 connected to a top end of the handle unit 91 and covering the capsule module 92, a damping unit 94 disposed in the accommodating space 910, and a terminal 95 disposed at a bottom end of the handle unit 91.

The capsule module 92 includes a transducer 921, a carrier 922 sustaining the transducer 921, and a wiring board 923. The transducer 921 is a conventional dynamic microphone capsule, and is configured for converting sound waves into an electrical signal. The wiring board 923 of the capsule module 92 is disposed at a bottom surface of the carrier 922, and is electrically connected to the transducer 921 and the terminal 95 for transmitting the electrical signal from the transducer 921 to the terminal 95. The damping unit 94 includes a connecting part 941 and two damping parts 942. The connecting part 941 of the damping unit 94 is mounted to the handle unit 91, and is proximate to the top end of the handle unit 91. Each of the damping parts 942 of the damping unit 94 is connected between a respective one of two opposite ends of the connecting part 941 and the carrier 922 of the capsule module 92.

The carrier 922 of the capsule module 92 of the conventional microphone 9 is glued directly to the damping parts 942 of the damping unit 94. When a user uses the conventional microphone 9, the user may inevitably rub his hand against the handle unit 91, turn and shake the handle unit 91, and operate a switch of the convention microphone 9. Those movements will cause a vibration on the handle unit 91. The wave of the vibration will propagate through the handle unit 91 and sequentially to the connecting part 941 and the damping parts 942 of the damping unit 94. Subsequently, the vibration is absorbed by the damping parts 942, and the amplitude of the wave of vibration is decreased. However, the vibration from the handle unit 91 cannot be entirely absorbed by the damping parts 942, and thus, a remaining part of the wave of the vibration is still propagated to the transducer 921 and is converted into an undesired noise signal. Moreover, when the amplitude of the vibration on the handle unit 91 is considerably large, the noise signal may be significant since the damping parts 942 can only absorb a certain amount of energy of the vibration.

SUMMARY

Therefore, an object of the disclosure is to provide a microphone capable of actively counteracting noise attributed to undesired vibration.

According to the disclosure, a microphone capable of actively counteracting noise attributed to undesired vibration comprises a handle unit, a windscreen, a processing circuit and a capsule module.

The handle unit includes a housing surrounding an axis and having an opening end, and a contact base mounted to the housing at the opening end and surrounding the axis. The contact base is configured for propagating vibration from the housing.

The windscreen is connected to the opening end of the housing, allows sound waves to propagate therethrough, and cooperates with the housing to define a chamber.

The capsule module is disposed in the chamber, and includes a carrier, a primary transducer unit, and a secondary transducer unit. The carrier includes a hollow part that is mounted coaxially to the contact base, a first carrier part that extends along the axis from the hollow part toward the windscreen, and a second carrier part that extends along the axis from the hollow part in a direction opposite to the first carrier part. The primary transducer unit is mounted to the first carrier part, and includes a first diaphragm that is configured for converting the sound waves and the vibration into first mechanical motion and that is passed through by the axis, and a primary transducer that is connected to and covered by the first diaphragm for converting the first mechanical motion into a first electrical signal composed of a primary electrical signal which is attributed to the sound waves and a first secondary electrical signal which is attributed to the vibration. The secondary transducer unit is mounted to the second carrier part, and includes a second diaphragm that is configured for converting the vibration into second mechanical motion and that is passed through by the axis, and a secondary transducer that is connected to and covered by the second diaphragm for converting the second mechanical motion into a second electrical signal composed of a second secondary electrical signal which is attributed to the vibration.

The hollow part, the second carrier part, and the secondary transducer cooperatively define an airtight space, and the second diaphragm is disposed within the airtight space.

The primary transducer and the secondary transducer are electrically connected to the processing circuit for transmitting the first and second electrical signals thereto, such that the second secondary electrical signal counteracts the first secondary electrical signal when the processing circuit receives the first and second electrical signals.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
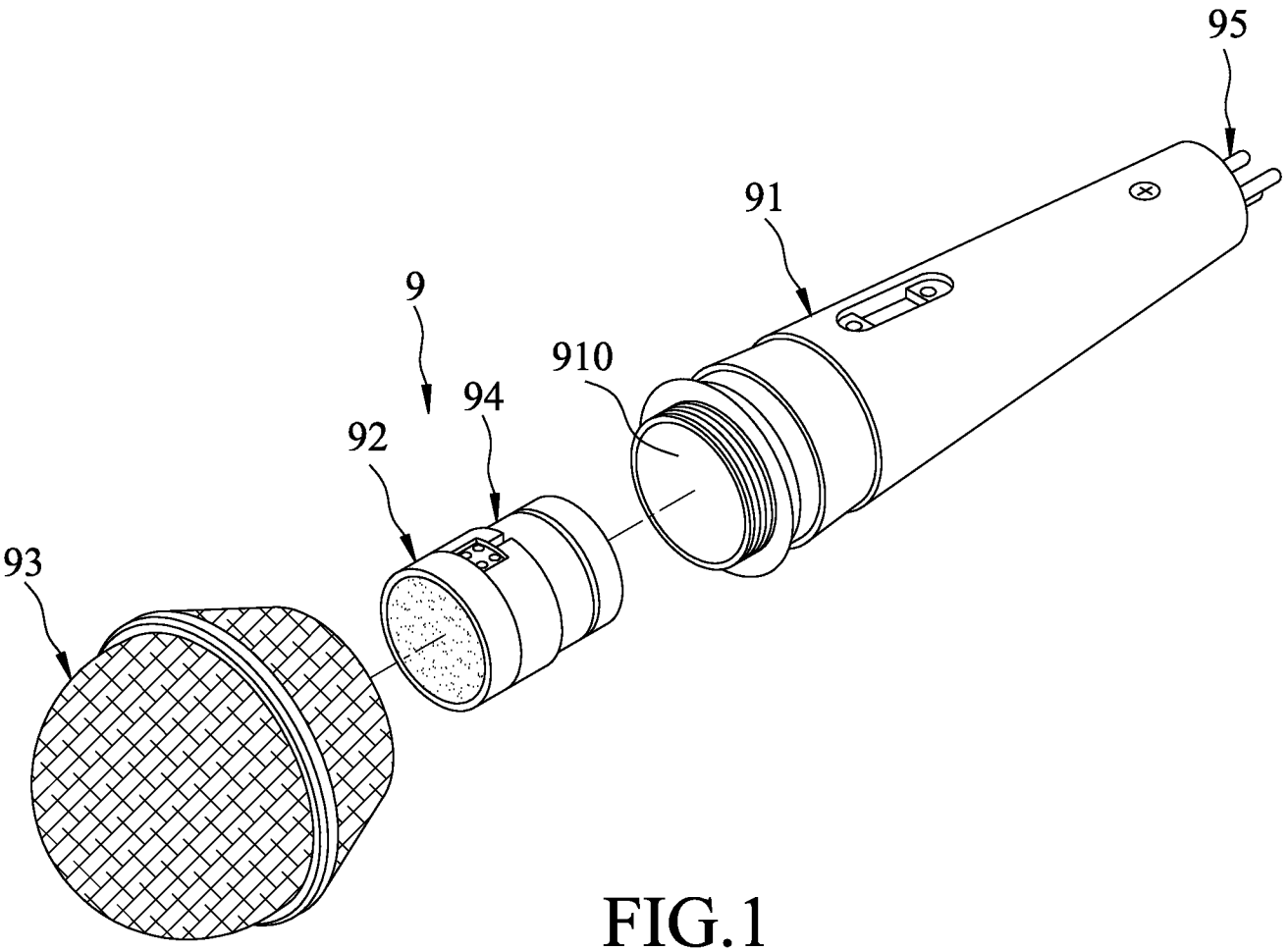
FIG.1 PRIOR ART
FIG. 1 is an exploded perspective view illustrating a conventional microphone.
Figure 2:
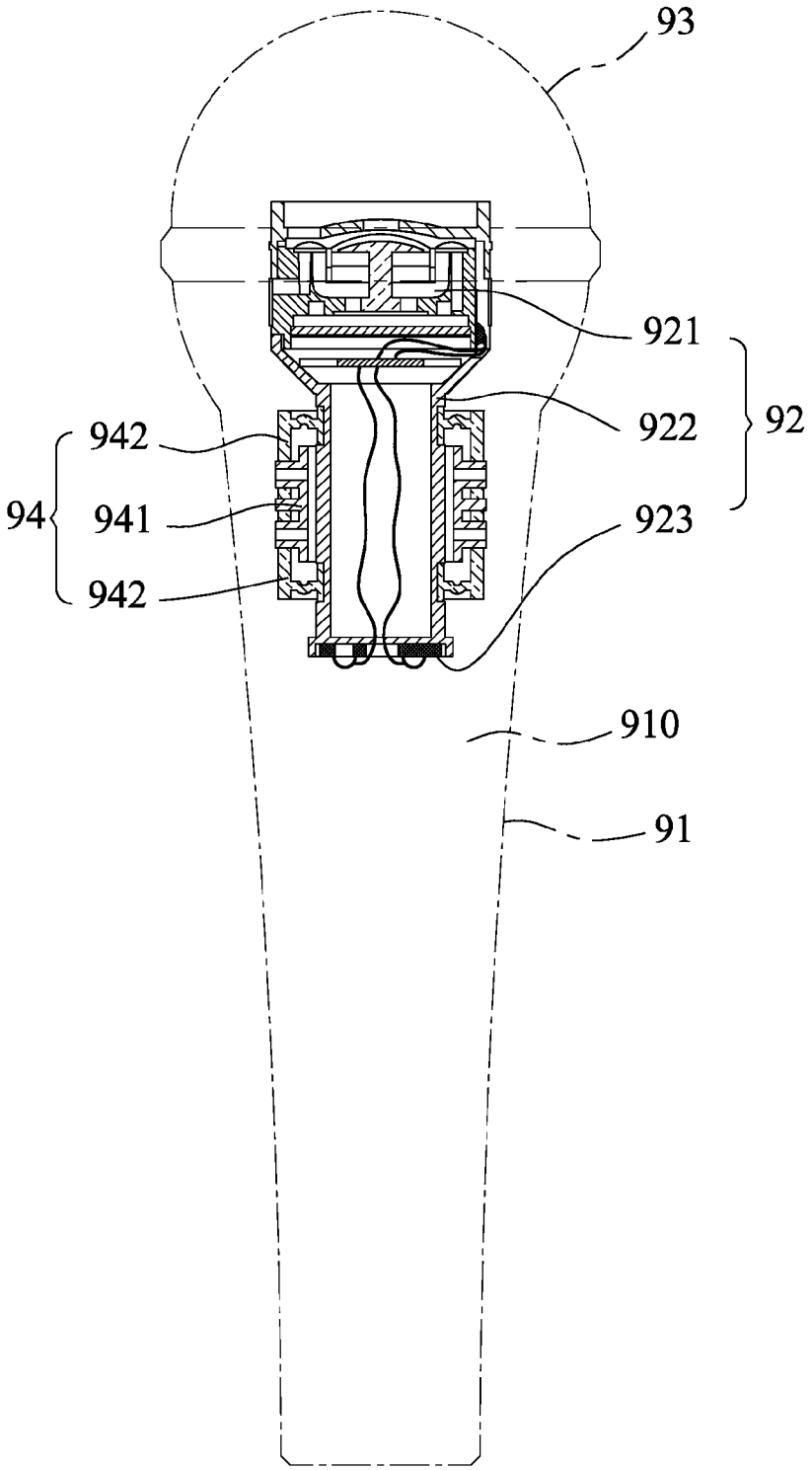
FIG.2 PRIOR ART
FIG. 2 is a cross-sectional view illustrating a capsule module and a damping unit of the conventional microphone.

Before the disclosure is described in greater detail, it should be noted that like elements are denoted by the same reference numerals throughout the disclosure.

Figure 3:
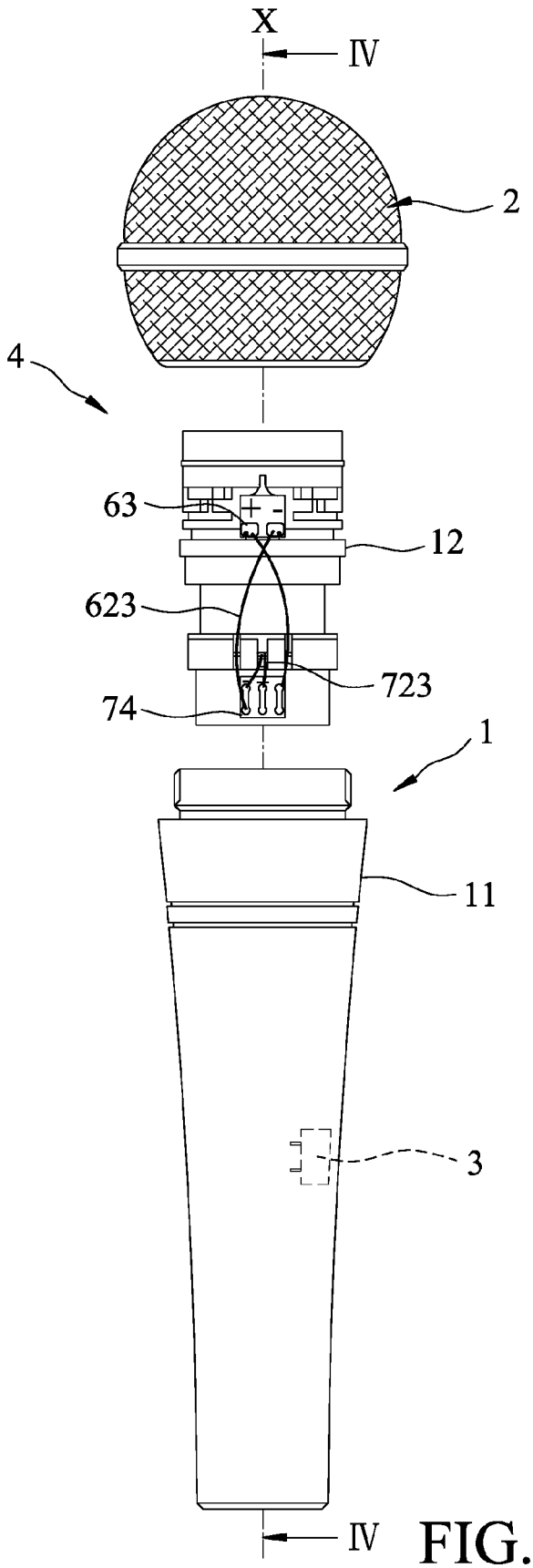
FIG. 3 is an exploded view illustrating a first embodiment of the microphone according to the disclosure.
Figure 4:
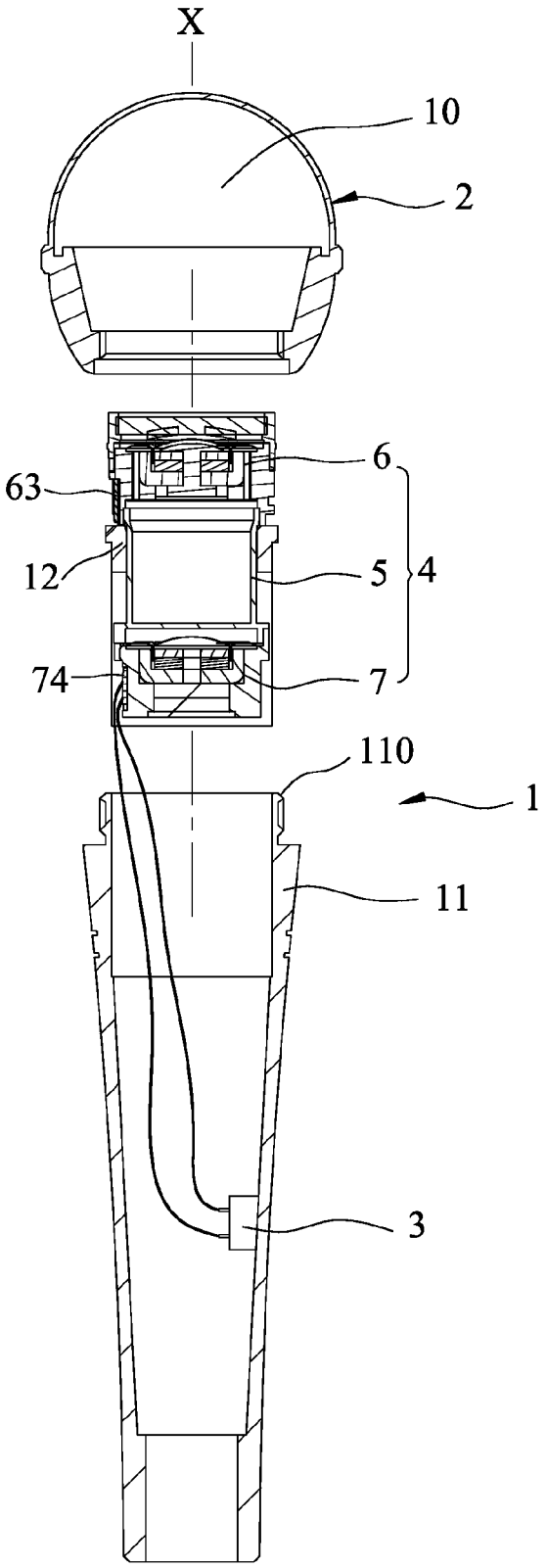
FIG. 4 is a exploded cross-sectional view taken alone line IV-IV in FIG. 3.

Referring to FIGS. 3 and 4, the first embodiment of the microphone according to the disclosure includes a handle unit 1, a windscreen 2, a processing circuit 3, and a capsule module 4.

The handle unit 1 includes a housing 11 surrounding an axis (X) and having an opening end 110, and a contact base 12 mounted to the housing 11 at the opening end 110 and surrounding the axis (X). The contact base 12 is configured for propagating vibration from the housing 11.

The windscreen 2 is connected to the opening end 110 of the housing 11, allows sound waves to propagate therethrough, and cooperates with the housing 11 to define a chamber 10.

The processing circuit 3 is disposed within the chamber 10 of the housing 11.

The capsule module 4 is disposed within the chamber 10, and includes a carrier 5, a primary transducer unit 6 and a secondary transducer unit 7.

Figure 5:
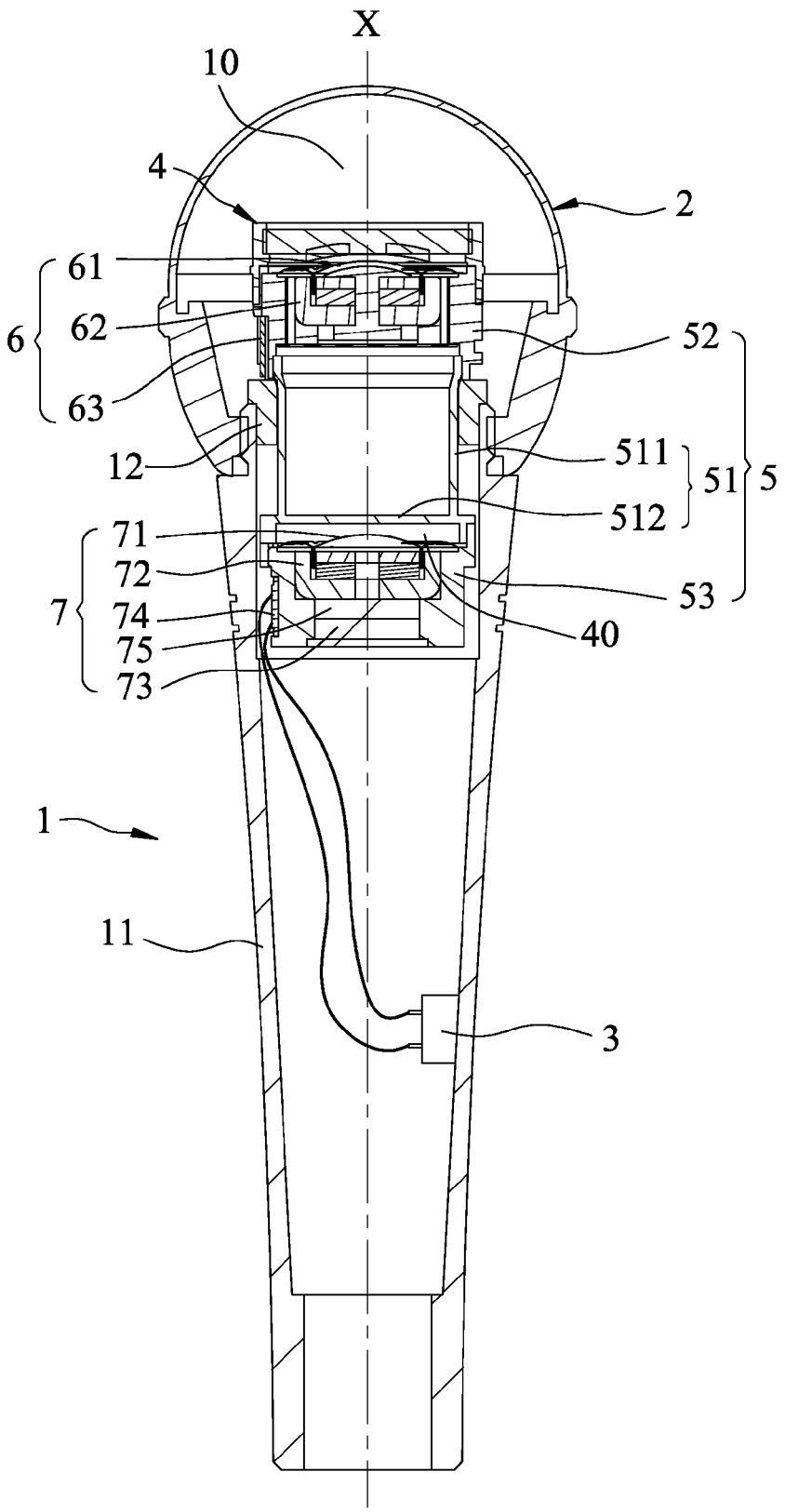
FIG. 5 is a cross-sectional view of the first embodiment of the microphone.
Figure 6:
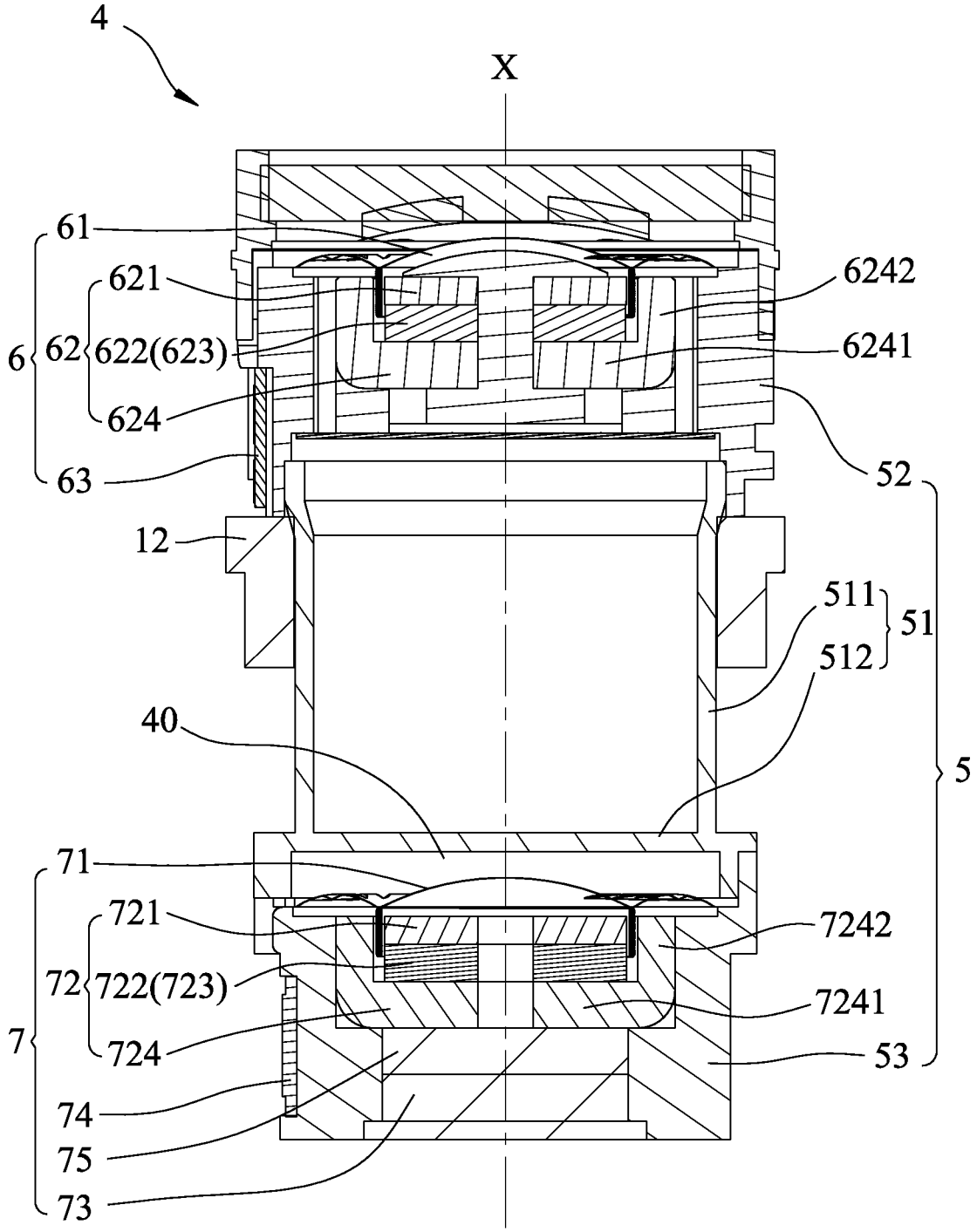
FIG. 6 is a cross-sectional view illustrating a capsule module mounted to a carrier of the first embodiment.

Further referring to FIGS. 5 and 6, the carrier 5 includes a hollow part 51 that is mounted coaxially to the contact base 12, a first carrier part 52 that extends along the axis (X) from the hollow part 51 toward the windscreen 2, and a second carrier part 53 that extends along the axis (X) from the hollow part 51 in a direction opposite to the first carrier part 52. Namely, the first carrier part 52 is closer to the windscreen 2 compared to the second carrier part 53. In this embodiment, the hollow part 51 includes a hollow main body 511 surrounding the axis (X), and a plate 512 connected to the main body 511 opposite to the first carrier part 52. The plate 512 is disposed perpendicular to and passed through by the axis (X), and is adjacent to the second carrier part 53. Each of the first and second carrier parts 52, 53 of the carrier 5 has an outer surface.

Figure 7:
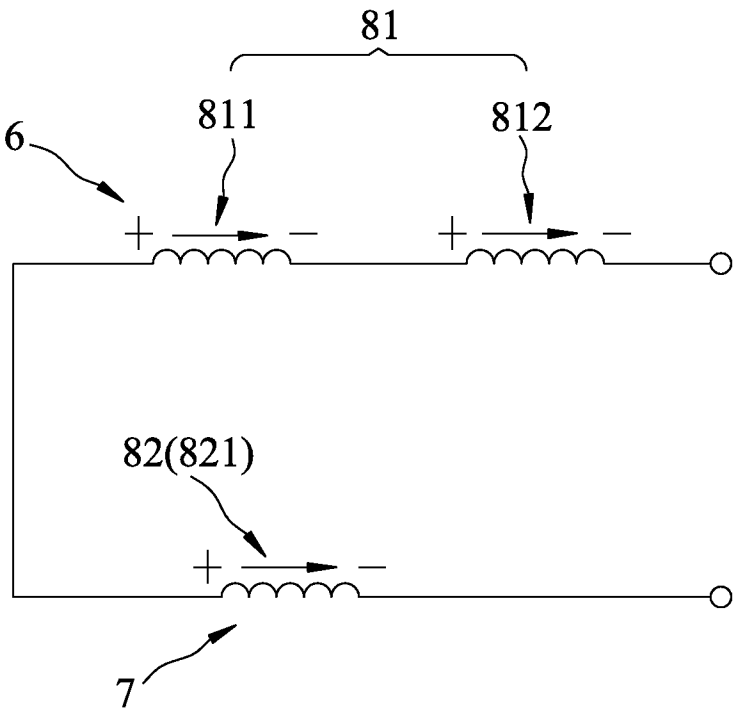
FIG. 7 is an equivalent-circuit diagram of the capsule module for illustrating electric connection between a primary transducer unit and a secondary transducer unit with opposite electrical polarity.

The primary transducer unit 6 is mounted to the first carrier part 52, and includes a first diaphragm 61, a primary transducer 62 and a primary wiring board 63. The first diaphragm 61 is passed through by the axis (X), and is configured for converting the sound waves passing through the windscreen 2 and the vibration, which is propagated from the contact base 12 through the carrier 5 to the primary transducer unit 6, into first mechanical motion. The primary transducer 62 is connected to and covered by the first diaphragm 61 for converting the first mechanical motion into a first electrical signal $1. The first electrical signal 81 is composed of a primary electrical signal 812 which is attributed to the sound waves, and a first secondary electrical signal 811 which is attributed to the vibration (see FIG. 7). The primary wiring board 63 is mounted to the outer surface of the first carrier part 52.

The secondary transducer unit 7 is mounted to the second carrier part 53, and includes a second diaphragm 71, a secondary transducer 72, a tuner 73 and a secondary wiring board 74. The second diaphragm. 71 is passed through by the axis (X), and is configured for converting the vibration, which is propagated from the contact base 12 through. the carrier 5 to the secondary transducer unit 7, into second mechanical motion. The secondary transducer 72 is connected to and coved by the second diaphragm 71 for converting the second mechanical motion into a second electrical signal 82 composed of a second secondary electrical signal 821 which is attributed to the vibration. The tuner 73 is configured for adjusting amplitude of vibration of the second diaphragm 71, is disposed at the second carrier part 53 and away from the windscreen 2 relative to the secondary transducer 72, and is passed through by the axis (X). The secondary wiring board 74 is mounted to the outer surface of the second carrier part 53.

In this embodiment, the plate 512 of the hollow part 51, the second carrier part 53 and the secondary transducer 72 cooperatively define an airtight space 40, and the second diaphragm 71 is disposed within the airtight space 40 for isolating the second diaphragm. 71 from the sound waves.

Figure 8:
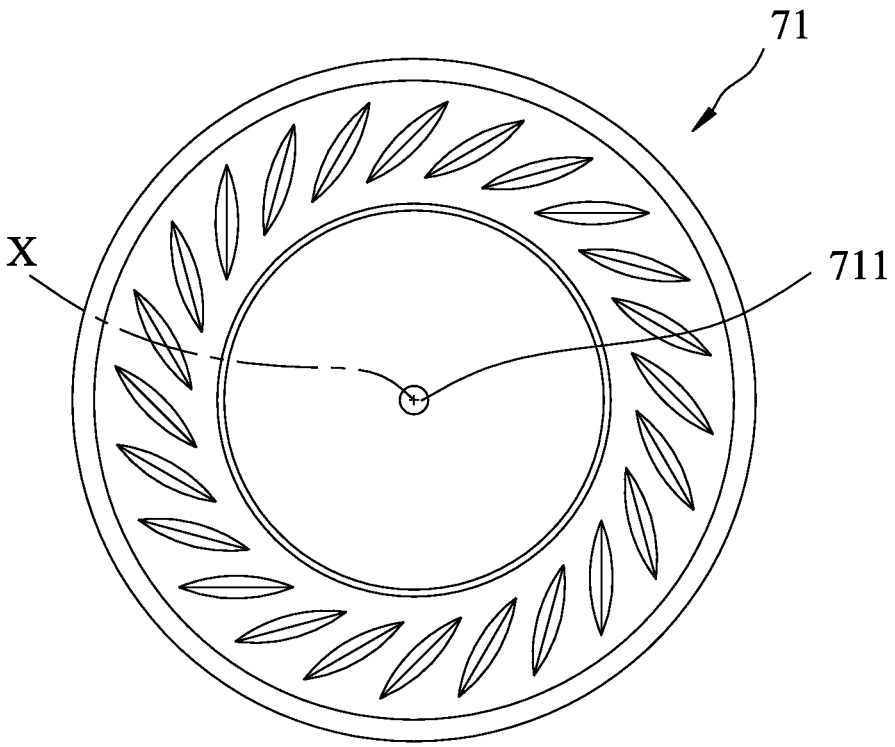
FIG. 8 is a plan view illustrating a diaphragm of the secondary transducer unit.

Since the second diaphragm 71 is disposed within the airtight space 40, the second diaphragm 71 may not vibrate due to equal pressure at two opposite sides of the second diaphragm 71 in the airtight space 40. Therefore, the second diaphragm 71 is formed with a through hole 711 (see FIG. 8), and the through hole 711 is passed through by the axis (X). By virtue of the through hole 711, the pressures at the two opposite sides of the second diaphragm 71 are allowed to change, such that the second diaphragm 71 can easily vibrate in the airtight space 40.

The primary transducer 62 and the secondary transducer 72 are electrically connected to the processing circuit 3 in opposite electrical polarity for transmitting the first electrical signal 81 and second electrical signal 82 thereto, so that the second secondary electrical signal 821 counteracts the first secondary electrical signal 811 when the processing circuit 3 receives the first electrical signal 81 and second electrical signal 82. Since the second secondary electrical signal 821 has a voltage substantially equal to a voltage of the first secondary electrical signal 811, and has electrical polarity opposite to that of the first secondary electrical signal 811, the second secondary electrical signal 821 counteracts the first. secondary electrical signal 811, and the processing circuit 3 may only receive the primary electrical signal 812 of the first electrical signal 81, which is attributed to the sound waves, from the primary transducer unit 6. As a result, a noise signal attributed to the vibration can be cancelled. Subsequently, the processing circuit 3 is operable to transmit the primary electrical signal 812 of the first electrical signal 81 to an external speaker connected to the microphone through a cable connector.

In particular, a distance between the first diaphragm 61 and the hollow part 51 along the axis (X) is substantially equal to a distance between the second diaphragm 71 and the hollow part 51 along the axis (X). By virtue of such structural configuration, a length of a propagation path of the vibration from the contact base 12 to the first diaphragm 61 is substantially equal to a length of a propagation path of the vibration from the contact base 12 to the second diaphragm 71. Accordingly, the first secondary electrical signal 811 and the second secondary electrical signal 821 may have similar waveform and amplitude. Further, since the primary transducer 62 and the secondary transducer 72 are electrically connected to the processing circuit 3 in opposite electrical polarity, the first secondary electrical signal 811 and the second secondary electrical signal 821 may have a difference in phase by 180 degrees.

In this embodiment, the primary transducer 62 and the secondary transducer 72 have a similar configuration, and each includes a washer 621, 721, a permanent magnet 622, 722, an induction coil 623, 723 and a yoke 624, 724. The washer 621, 721 surrounds the axis (X), and is covered by a corresponding one of the first diaphragm 61 and the second diaphragm 71. The permanent magnet 622, 722 surrounds the axis (X), and is disposed with respect to the washer 621, 721 in an axial direction from the windscreen 2 toward the washer 621, 721 (i.e., a downward direction in FIG. 6). The induction coil 623, 723 is wound around the permanent magnet 622, 722, is placed in the magnetic field of the permanent magnet 622, 722, and is electrically connected to the processing circuit 3. The yoke 624, 724 has a plate part 6241, 7241 that is disposed with respect to the permanent magnet 622, 722 in the axial direction, and an extension part 6242, 7242 that extends from peripheral of the plate part in a direction opposite to the axial direction (i.e., an upward direction in FIG. 6) and that surrounds the washer 621, 721 and the permanent magnet 622, 722.

The induction coil 623 of the primary transducer 62 is electrically connected to the primary wiring board 63, the secondary wiring board 74 and the processing circuit 3 in sequence, and the induction coil 723 of the secondary transducer 72 is electrically connected to the secondary wiring board 74 and the processing circuit 3 in sequence. Referring to FIGS. 3 to 7, one end of the induction coil 623 of the primary transducer 62 is electrically connected to a positive electrode (+) of the primary wiring board 63 that is then electrically connected to the processing circuit 3 through the secondary wiring board 74, and the other end is electrically connected to a negative electrode (−) of the primary wiring board 63 and then to a negative electrode (−) of the secondary wiring board 74. One end of the induction coil 723 of the secondary transducer 72 is electrically connected to the negative electrode (−) of the secondary wiring board 74 and then to the processing circuit 3, and the other end is electrically connected to a positive electrode (+) of the secondary wiring board 74 and then to the processing circuit 3. Accordingly, the primary transducer 62 and the secondary transducer 72 are electrically connected to the processing circuit 3 in opposite electrical polarity.

It should be appreciated that, although the induction coil 623 of the primary transducer 62 is connected directly to the primary wiring board 63 and the secondary wiring board 74 as shown in FIG. 3, it may be connected electrically and sequentially to the primary wiring board 63 and the secondary wiring board 74 via a plurality of cables (not shown) in practice. Similarly, although the induction coil 723 of the secondary transducer 72 is connected directly to the secondary wiring board 74 as shown in FIG. 3, it may be connected electrically to the secondary wiring board 74 via a plurality of cables (not shown) in practice.

Figure 9:
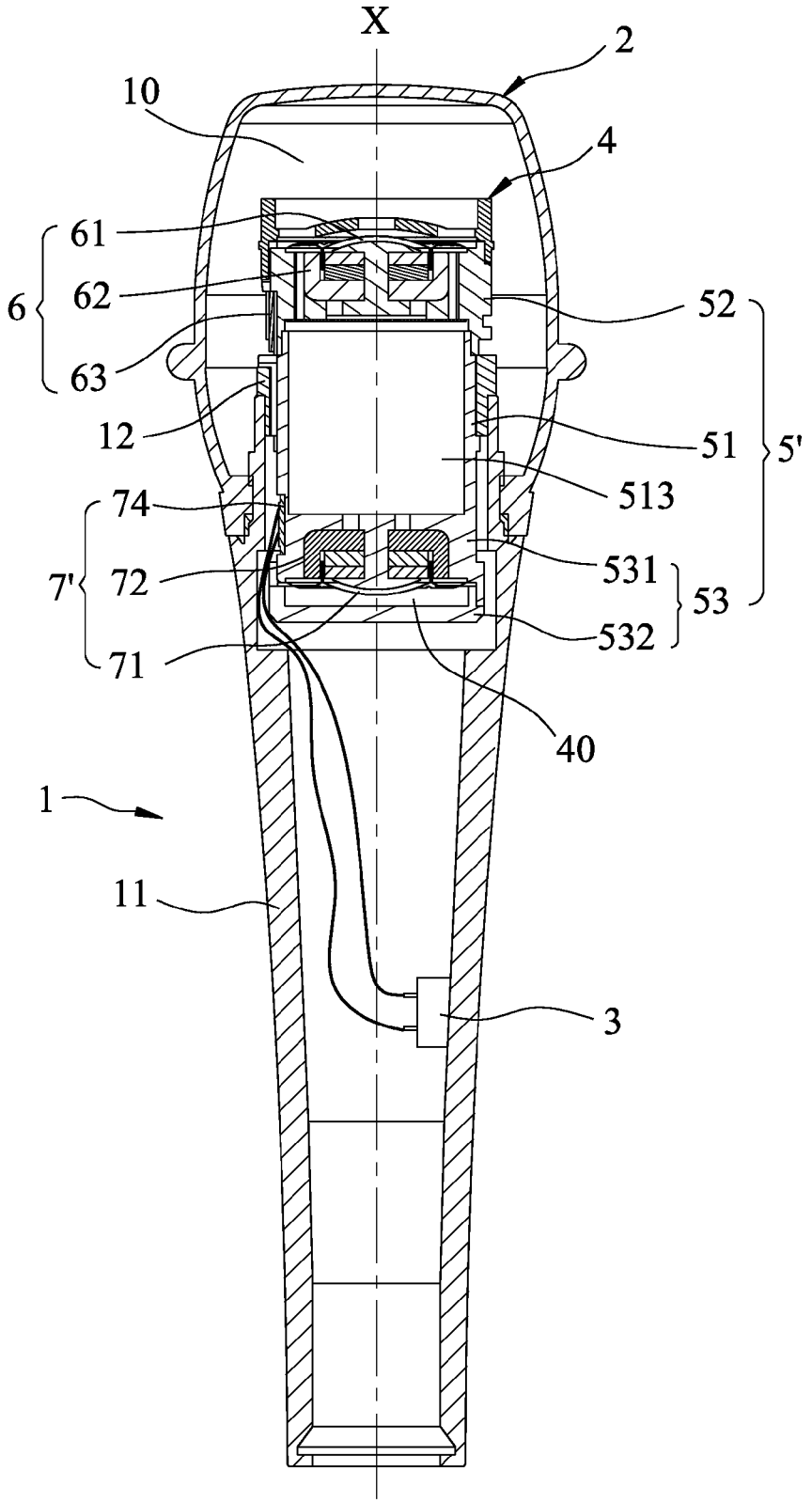
FIG. 9 is a cross-sectional view illustrating a second embodiment of the microphone according to the disclosure.
Figure 10:
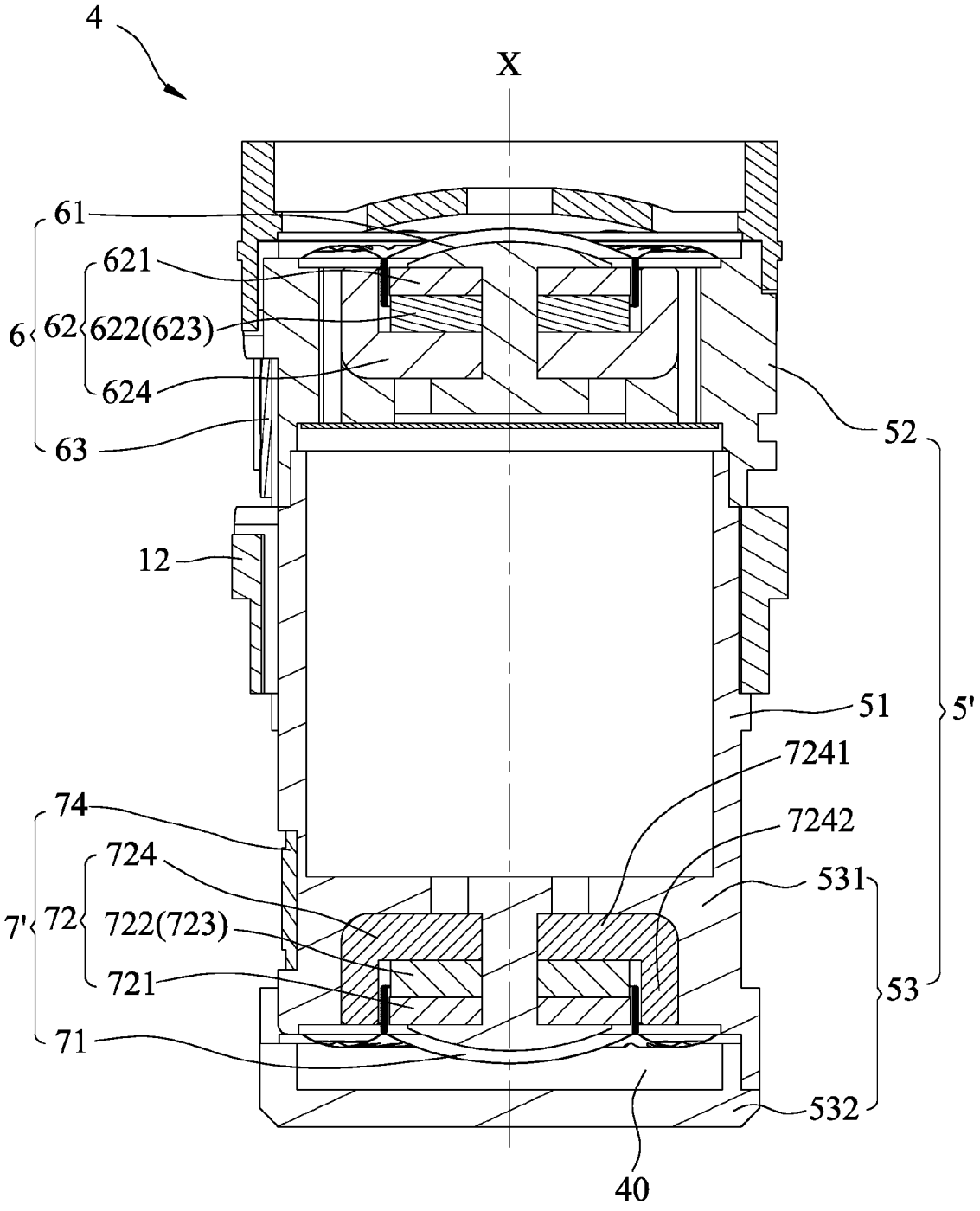
FIG. 10 is a cross-sectional view illustrating a capsule module mounted to a carrier of the second embodiment.

Referring to FIGS. 9 and 10, the second embodiment of the microphone according to the disclosure is shown to be similar to the first embodiment. In the second embodiment, the carrier 5' of the capsule module 4 includes a hollow part 51, a first carrier part 52 mounting the primary transducer unit 6, and a second carrier part 53 mounting the secondary transducer unit 7. The second carrier part 53 includes a connecting segment 531 and a cover 532. The connecting segment 531 is connected to the hollow part 51, and accommodates the secondary transducer unit 7. The cover 532 is disposed with respect to the connecting segment 531 in the axial direction, and is air tightly connected to the connecting segment 531.

In this embodiment, the primary transducer unit 6 of the capsule module 4 is identical to that of the first embodiment, and the secondary transducer unit 7' only includes the second diaphragm 71, the secondary transducer 72 and the secondary wiring board 74. The secondary transducer 72 includes a washer 721, a permanent magnet 722, an induction coil 723 and a yoke 724. The washer 721 surrounds the axis (X), and is covered by the second diaphragm 71. The permanent magnet 722 surrounds the axis (X), and is disposed with respect to the washer 721 in the opposite direction (i.e., the upward direction in FIG. 10). The induction coil 723 is wound around the permanent magnet 722, is positioned in the magnetic field of the permanent magnet 722, and is electrically connected to the processing circuit 3. The yoke 724 has a plate part 7241 that is disposed with respect to the permanent magnet 722 in the opposite direction, and an extension part 7212 that extends from the plate part in the axial direction (i.e., the downward direction in FIG. 10) and that surrounds the washer 721 and the permanent magnet 722.

In this embodiment, the over 532, the hollow part 51, the connecting segment 531 and the secondary transducer 72 cooperatively define the airtight space 40, within which the second diaphragm 71 is disposed. The connecting segment 531 of the second carrier part 53 has an outer surface, and the secondary wiring board 74 of the secondary transducer unit 7 is mounted to the outer surface of the connecting segment 531.

The mechanism and principle of the cancellation of the noise signal caused by the vibration in the second embodiment are the same as those of the first embodiment, and are omitted herein for the sake of brevity.

Figure 11:
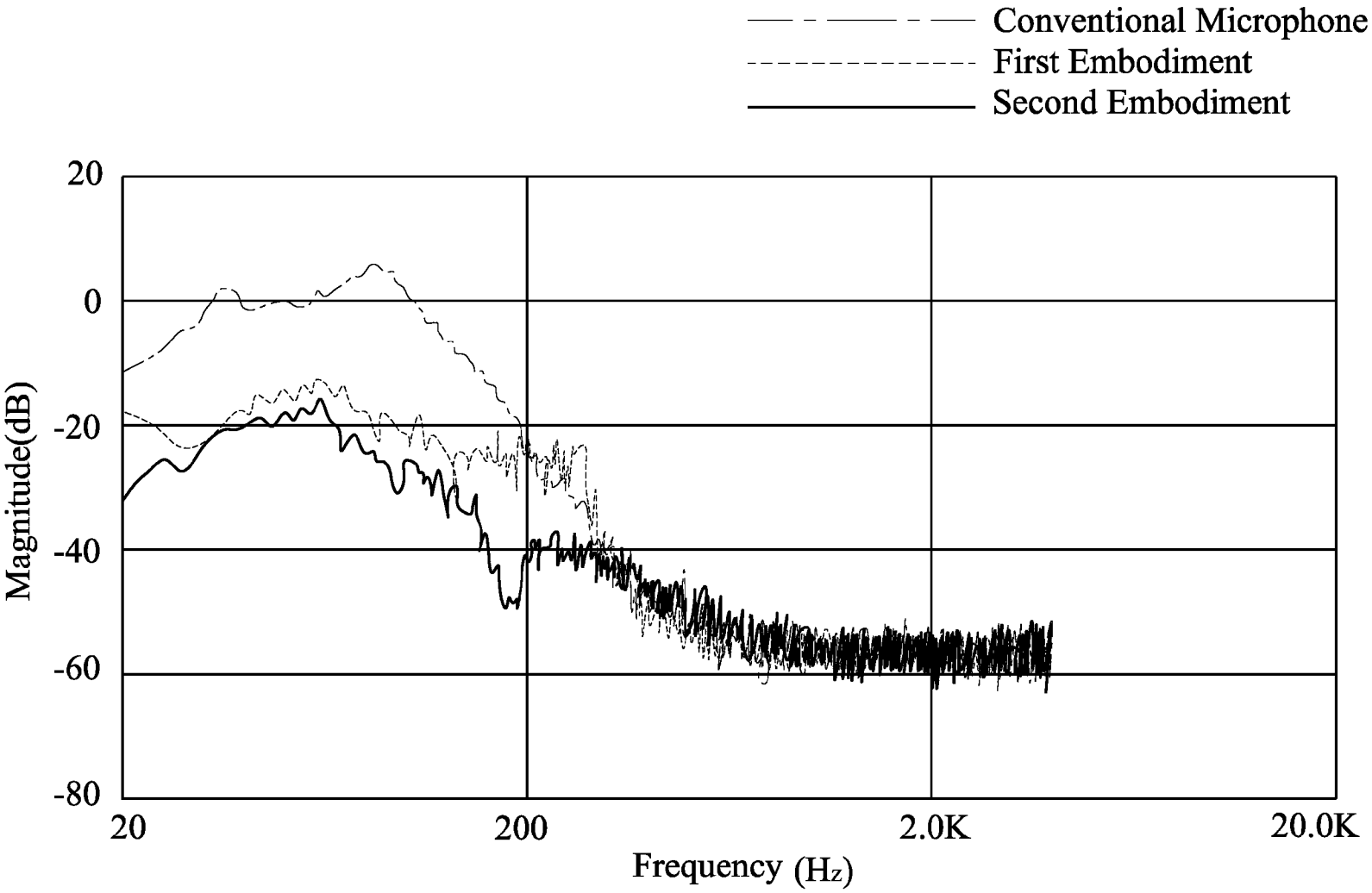
FIG. 11 is a frequency response diagram illustrating magnitude of noise signals yielded by the conventional microphone, and the first and second embodiments of the disclosure.

FIG. 11 is a frequency response diagram illustrating magnitude of noise signals yielded by the conventional microphone 9, and by the first and second embodiments of the disclosure. It can be seen from FIG. 11 that, in the frequency range from 20 Hz to 200 Hz, the magnitude of the noise signal yielded by the conventional microphone 9 shown in FIGS. 1 and is greater than that yielded by the microphone according to any one of the first and second embodiments.

It is worth mentioning that, in the second embodiment, components of the primary transducer unit 6 and those of the secondary transducer unit 7 are arranged along the axis (X), and are symmetrical relative to an imaginary plane perpendicular to the axis (X). Accordingly, media for the vibration along the propagation path from the contact base 12 to the first diaphragm 61 is substantially identical to media for the vibration along the propagation path from the contact base 12 to the second diaphragm 71. Further, the hollow part 51 of the carrier 5' acts as a resonant cavity for both of the primary transducer unit 6 and the secondary transducer unit 7. Therefore, in the second embodiment, the waveform of the first secondary electrical signal 811 of the first electrical signal 81 is more similar to that of the second secondary signal 821 of the second electrical signal 82. As a result, in the frequency range from 20 Hz to 200 Hz, the magnitude of the noise signal in the second embodiment is lower than that in the first embodiment.

In sum, the distance between the first diaphragm 61 and the hollow part 51 along the axis (X) is substantially equal to the distance between the second diaphragm 71 and the hollow part 51 along the axis (X), and thus, the length of the propagation path of the vibration from the contact base 12 to the first diaphragm 61 is substantially equal to the length of the propagation path of the vibration from the contact base 12 to the second diaphragm 71. Further, the primary transducer 62 and the secondary transducer 72 are electrically connected to the processing circuit 3 in opposite electrical polarity, and thus, the first secondary electrical signal 811 and the second secondary electrical signal 821 attributed to the vibration are counteracted. Consequently, the noise signal caused by the vibration can be decreased.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A microphone capable of actively counteracting noise attributed to undesired vibration, said microphone comprising:

a handle unit including a housing surrounding an axis, and having an opening end, and a contact base mounted to said housing at said opening end, surrounding the axis, and configured for propagating vibration from said housing;

a windscreen connected to said opening end of said housing, allowing sound waves to propagate therethrough, and cooperating with said housing to define a chamber;

a processing circuit; and a capsule module disposed in said chamber, and including a carrier including a hollow part that is mounted coaxially to said contact base, a first carrier part that extends along the axis from said hollow part toward said windscreen, and a second carrier part that extends along the axis from said hollow part in a direction opposite to said first carrier part, a primary transducer unit mounted to said first carrier part and including a first diaphragm that is configured for converting the sound waves and the vibration into first mechanical motion and that is passed through by the axis, and a primary transducer that is connected to and covered by said first diaphragm for converting the first mechanical motion into a first electrical signal composed of a primary electrical signal which is attributed to the sound waves and a first secondary electrical signal which is attributed to the vibration, and a secondary transducer unit mounted to said second carrier part and including a second diaphragm that is configured for converting the vibration into second mechanical motion and that is passed through by the axis, and a secondary transducer that is connected to and covered by said second diaphragm for converting the second mechanical motion into a second electrical. signal composed of a second secondary electrical signal which is attributed to the vibration;

wherein said hollow part, said second carrier part and said secondary transducer cooperatively define an airtight space, and said second diaphragm is disposed within the airtight space;

wherein said primary transducer and said secondary transducer are electrically connected to said processing circuit for transmitting the first and second electrical signals thereto, so that the second secondary electrical signal counteracts the first secondary electrical signal when said processing circuit receives the first and second electrical signals.

2. The microphone as claimed in claim 1, wherein a distance between said first diaphragm and said hollow part along the axis is substantially equal to a distance between said second diaphragm and said hollow part along the axis.

3. The microphone as claimed in claim 1, wherein said second diaphragm of said secondary transducer unit is formed with a through hole.

4. The microphone as claimed in claim 3, wherein said through hole of said second diaphragm is passed through by the axis.

5. The microphone as claimed in claim 1, wherein each of said primary transducer and said secondary transducer includes:

a washer surrounding the axis, and covered by a corresponding one of said first and second diaphragms;

a permanent magnet surrounding the axis and disposed with respect to said washer in an axial direction from said windscreen toward said washer;

an induction coil wound around said permanent magnet, placed in the magnetic field of said permanent magnet, and electrically connected to said processing circuit; and a yoke having a plate part that is disposed with respect to said permanent magnet in the axial direction, and an extension part that extends from said plate part in a direction opposite to the axial direction and that surrounds said washer and said permanent magnet.

6. The microphone as claimed in claim 5, wherein each of said first and second carrier parts of said carrier has an outer surface, and said primary transducer unit further includes a primary wiring board mounted to said outer surface of said first carrier part, and said secondary transducer unit further includes a secondary wiring board mounted to said outer surface of said second carrier part, wherein said induction coil of said primary transducer is electrically connected to said primary wiring board, said secondary wiring board and said processing circuit in sequence, and said induction coil of said secondary transducer is electrically connected to said secondary wiring board and said processing circuit in sequence.

7. The microphone as claimed in claim 1, wherein said hollow part of said carrier includes a hollow main body surrounding the axis, and a plate connected to said main body opposite to said first carrier part, disposed perpendicular to and passed through by the axis, and cooperating with said second carrier part and said secondary transducer to define the airtight space.

8. The microphone as claimed in claim 1, wherein:

said primary transducer includes a first washer surrounding the axis, and covered by said first diaphragm, a first permanent magnet surrounding the axis and disposed with respect to said first washer in an axial direction from said windscreen toward said first washer, a first induction coil wound around said first permanent magnet, positioned in the magnetic field of said first permanent magnet, and electrically connected to said processing circuit, and a first yoke having a plate part that is disposed with respect to said first permanent magnet in the axial direction, and a extension part that extends from said plate part in an opposite direction opposite to the axial direction and that surrounds said first washer and said first permanent magnet; and said secondary transducer includes a second washer surrounding the axis, and covered by said second diaphragm, a second permanent magnet surrounding the axis and disposed with respect to said second washer in the opposite direction, a second induction coil winding around said second permanent magnet, positioned in the magnetic field of said second permanent magnet, and electrically connected to said processing circuit, and a second yoke having a plate part that is disposed with respect to said second permanent magnet in the opposite direction, and a extension part that extends from said plate part in the axial direction and that surrounds said second washer and said second permanent magnet.

9. The microphone as claimed in claim 8, wherein said second carrier part of said carrier includes:

a connecting segment connected to said hollow part and accommodating said secondary transducer unit; and a cover disposed with respect to said connecting segment in the axial direction, air tightly connected to said connecting segment, and cooperating with said hollow part, said connecting segment and said secondary transducer to define the airtight space.

10. The microphone as claimed in claim 9, wherein each of said first carrier part and said connecting segment of said second carrier part has an outer surface, and said primary transducer unit further includes a primary wiring board mounted to said outer surface of said first carrier part, and said secondary transducer unit further includes a secondary wiring board mounted to said outer surface of said connecting segment, wherein said induction coil of said primary transducer is electrically connected to said primary wiring board, said secondary wiring board and said processing circuit in sequence, and said induction coil of said secondary transducer is electrically connected to said secondary wiring board and said processing circuit in sequence.

11. The microphone as claimed in claim 1, wherein said secondary transducer unit further includes a tuner configured for adjusting amplitude of vibration of said second diaphragm, and disposed at said second carrier part and away from said windscreen relative to said secondary transducer.

* * * * *